US010021907B2

(12) United States Patent
Bavar

(10) Patent No.: US 10,021,907 B2
(45) **Date of Patent: *Jul. 17, 2018**

(54) HOOKAH BOWL

(71) Applicant: KALOUD, INC., Los Angeles, CA (US)

(72) Inventor: Reza Bavar, Los Angeles, CA (US)

(73) Assignee: KALOUD, INC., Los Angeles, CA (US)

( * ) Notice: Subject to any disclaimer, the term of this patent is extended or adjusted under 35 U.S.C. 154(b) by 523 days.

This patent is subject to a terminal disclaimer.

(21) Appl. No.: 14/549,435

(22) Filed: Nov. 20, 2014

(65) Prior Publication Data

US 2016/0143351 A1 May 26, 2016

(51) Int. Cl.
*A24F 5/00* (2006.01)
*A24F 1/30* (2006.01)

(52) U.S. Cl.
CPC . *A24F 5/00* (2013.01); *A24F 1/30* (2013.01)

(58) Field of Classification Search
CPC ..... A24F 5/00; A24F 1/30; A24F 5/02; A24F 5/08; A24F 5/10; A24F 5/14
USPC ..... 131/226, 217, 209, 196, 173; D27/167, D27/162, 166
See application file for complete search history.

(56) References Cited

U.S. PATENT DOCUMENTS 7,827,995 B2 11/2010 Chaoui
D785,235 S * 4/2017 Elhalwani ..... D27/167
2005/0279371 A1 12/2005 Billard et al.
2007/0062548 A1* 3/2007 Horstmann ..... A24F 47/002 131/270
2007/0215164 A1* 9/2007 Mehio ..... A24F 1/30 131/173
2010/0101590 A1* 4/2010 Pflaum ..... A24F 1/30 131/222
2010/0126516 A1 5/2010 Yomtov et al.
2010/0126517 A1* 5/2010 Groff ..... A24F 1/30 131/173
2010/0126518 A1 5/2010 Saleh
2010/0212679 A1 8/2010 Bishara
2010/0242973 A1 9/2010 Mehio
2011/0088706 A1* 4/2011 Badawi ..... A24F 1/30 131/173
2013/0330680 A1 12/2013 Bavar
2014/0026902 A1* 1/2014 Dabes ..... A24F 5/00 131/226
2014/0326257 A1 11/2014 Jalloul et al.
(Continued)

FOREIGN PATENT DOCUMENTS

EP 2179667 A1 4/2010
WO WO 2016023325 A1 * 2/2016 ..... A24F 1/30

OTHER PUBLICATIONS

"Packing the Vortex Bowl—A Comprehensive Guide of Awesome". Hookah Time Blog. May 14, 2010. <http://hookahhookah.com>.*
(Continued)

*Primary Examiner* — Michael J Felton
*Assistant Examiner* — Sonny V Nguyen
(74) *Attorney, Agent, or Firm* — One LLP; Joseph K. Liu

(57) ABSTRACT

A bowl for a water pipe comprising: an interior space defined by an inner surface of the bowl; and one or more walls separating the inner space into a plurality of compartments for holding organic matter to be smoked by a user.

18 Claims, 9 Drawing Sheets

(56) References Cited

U.S. PATENT DOCUMENTS

| | | | | |
|---|---|---|---|---|
| 2017/0055570 | A1* | 3/2017 | Elhalwani | A24F 1/30 |
| 2017/0172203 | A1* | 6/2017 | Gebara | A24F 5/00 |

OTHER PUBLICATIONS

"Rib." Merriam-Webster.com. Merriam-Webster, n.d. Web. Jul. 19, 2017.*

Katsumi1980. "Why is Hookah Seen as a Kids Toy in America'?". Dec. 11, 2009. <https://katsumi1980.wordpress.com>.*

WO, PCT/US2014/066709 ISR, dated Feb. 23, 2015.

WO, PCT/US2015/062019 ISR and Written Opinion, dated Mar. 3, 2016.

WO, PCT/US2015/062020 ISR and Written Opinion, dated Mar. 3, 2016.

* cited by examiner

HOOKAH BOWL

BACKGROUND OF THE INVENTION

The subject matter described herein relates generally to a system, device, and method preparing tobacco for smoking using a water pipe, such as a hookah. Traditional water pipes generally include a plate for supporting charcoal, a head for containing tobacco, a body including an internal pipe, a base for containing water, and a hose. Typically a user will first fill the base with water and then place the internal pipe into the water such that the body creates an airtight seal with the base. The head is then filled with tobacco and placed over the internal pipe such that an airtight seal is created between the internal pipe and the head. Next the user places the plate over the head, places one or more lit charcoals on the plate and these charcoals serve to heat the tobacco underneath the plate. The hose is typically attached to the body such that it has an airtight connection with air above the water in the base. The user can inhale through the hose which draws smoke from the heated tobacco in the head through the internal pipe, through the water contained in the base, through the hose and into the user's lungs.

The embodiments provided herein teach features and advantages heretofore untaught by the prior art, as will be clear to one of ordinary skill in the art.

SUMMARY OF THE INVENTION

Briefly and in general terms, the embodiments described herein provide for a system, method and device for smoking tobacco (or other organic matter) via a water pipe.

These and other aspects and advantages of the instant invention will be apparent from the following detailed description and the accompanying drawing, which illustrates by way of example the principles and features of the instant invention.

BRIEF DESCRIPTION OF THE SEVERAL VIEWS OF THE DRAWING(S)

Illustrated in the accompanying drawing(s) is at least one of the best mode embodiments of the present invention. In such drawing(s):

DETAILED DESCRIPTION OF THE PREFERRED EMBODIMENTS

Figure 1A:
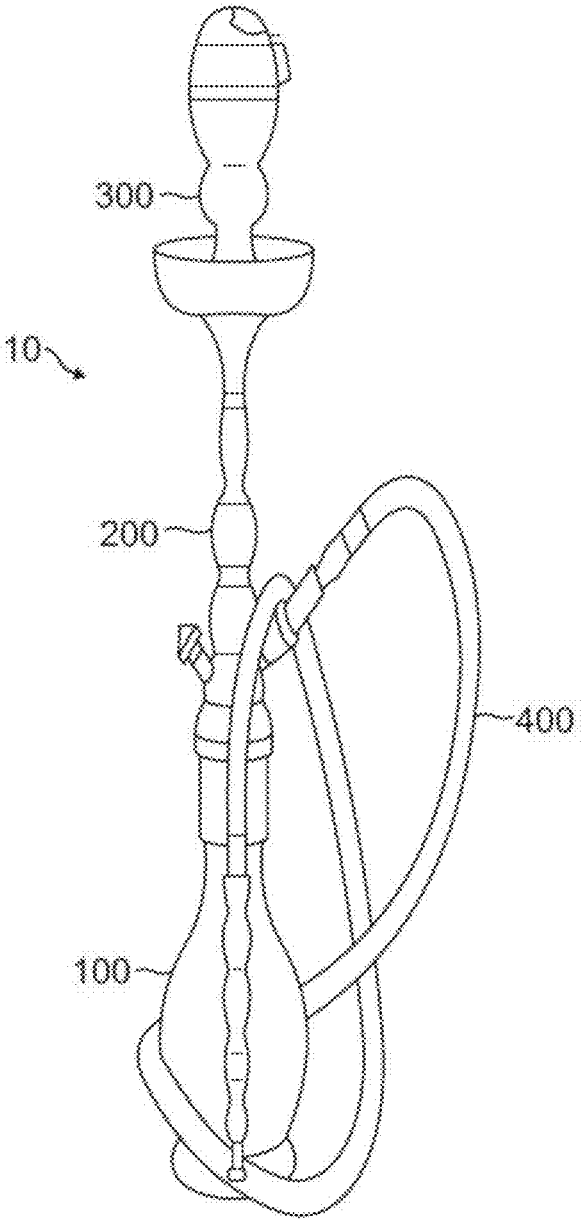
FIG. 1A illustrates an exemplary water pipe according to at least one embodiment of the present invention.

The above described drawing figures illustrate the described invention and method of use in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

FIG. 1 illustrates an exemplary water pipe 10 according to at least one embodiment of the present invention. As shown in FIG. 1A, the water pipe generally comprises: a base 100, a stem 200, a bowl 300, and a hose 400. An exemplary water pipe is described in U.S. patent application Ser. No. 13/489,475, filed on Jun. 6, 2012, the entire contents and disclosure of which is herein incorporated by reference.

Figure 1B:
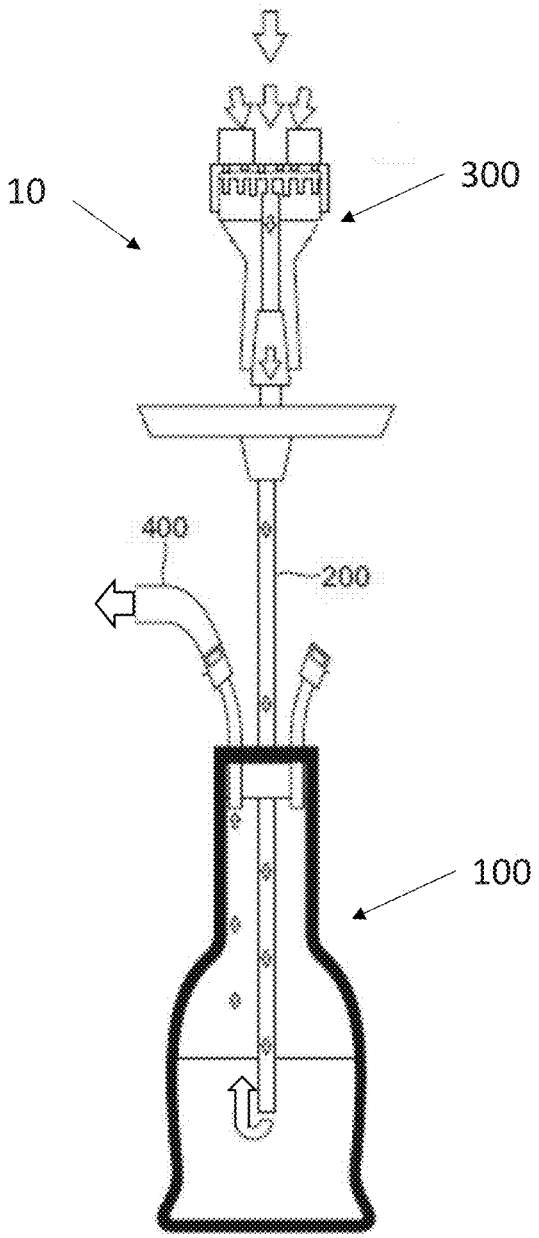
FIG. 1B shows a schematic view of an exemplary water pipe according to at least one embodiment of the present invention

As shown for example in FIG. 1B, in general, the base 100 comprises a concave vessel having an open top portion for containing water or other liquid therein. The stem 200 extends into the base 100 such that a distal end of the stem 200 is partially submerged within the liquid contained therein. The stem 200 also couples to the open top portion of the base 100 so as to form a substantially airtight seal therewith. Accordingly, a first grommet may be provided to couple the stem 200 and the base 100 so as to form the substantially airtight seal. In this manner, a chamber is formed by the base 100 and stem 200/grommet. The hose 400 extends into the base 100 such that a proximal portion of the hose 400 is within the chamber, though preferably not within the contained liquid. Preferably, a substantially airtight seal is formed from the coupling of the hose 400 and base 100. Accordingly, a second grommet may be provided to couple the hose 400 and the base 100 so as to form the substantially airtight seal. In some embodiments, a hose valve may be intermediate the hose 400 and the base 100, the hose valve extending into the chamber at one end and exterior to the chamber, coupling with the hose, at the other. The bowl 300 couples to a proximal end of the stem 200 such that a substantially airtight seal is formed therebetween. Accordingly, a third grommet may be provided to couple the bowl 300 and the stem 200 so as to form the substantially airtight seal. In operation, the organic matter to be smoked may be contained within the bowl 300, and the bowl 300 covered with a cover, such as punctured foil, or the ventilated cover described in U.S. patent application Ser. No. 13/489,475, filed on Jun. 6, 2012, the entire contents and disclosure of which is herein incorporated by reference.

Critically, the bowl 300, stem 200 and hose 400 each comprise a hollow tube such that when the base 100, bowl 300, stem 200, and hose 400 are coupled, an airflow path is formed. As illustrated in FIG. 1B, a user inhaling at the distal end of the hose 400 may thus draw heated air into the bowl 300, causing the organic material therein to bum, releasing smoke that is subsequently drawn through the bowl 300, through the stem 200, and into the liquid contained within the base 100. The smoke then rises through the liquid into the chamber, becoming filtered in the process, and out through the hose 400 to be smoked by the user.

Other water pipe components, such as purge valves, ashtrays, base flavorings, etc. are generally known in the art and, while not specifically described herein, are intended to be useable in combination with the presently described embodiments without departing from the scope of the invention.

An exemplary bowl 300 in accordance with the present invention will now be described with reference to FIG. 2.

Figure 2A:
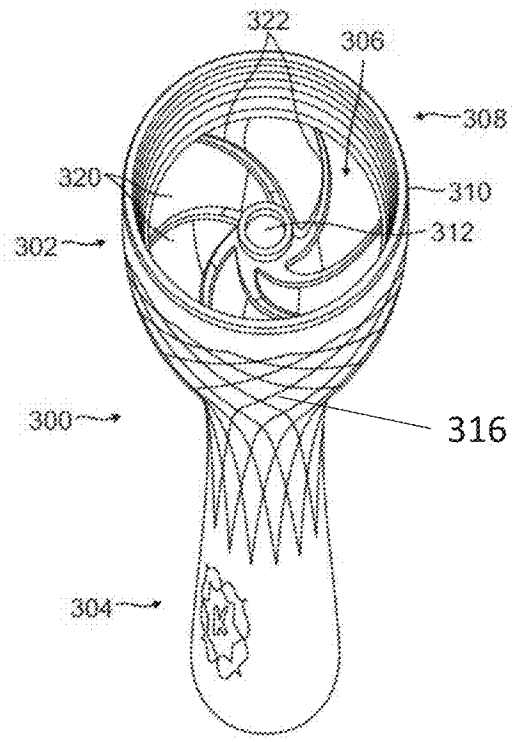
FIG. 2A shows a perspective view of an exemplary bowl according to at least one embodiment of the present invention.

As shown for example in FIG. 2A, with the bowl generally comprises a substantially hemispherical bowl head 302 extending vertically and radially from a substantially cylindrical bowl stalk 304. The bowl further comprises interior 306 and exterior 308 surfaces separated by a rim portion 310. Located central to the bowl head, and forming a portion of the inner surface of the bowl, is the hollow tube 312 extending the length of the bowl from the bowl head through the bowl stalk.

The bowl head further comprises a plurality of compartments 320 therein for containing the organic matter (and/or other material) to be smoked. A plurality of internal walls 322 extends inward from the interior surface of the bowl head towards the hollow tube, forming the plurality of compartments. Accordingly, each internal wall separates adjacent compartments.

Figure 2B:
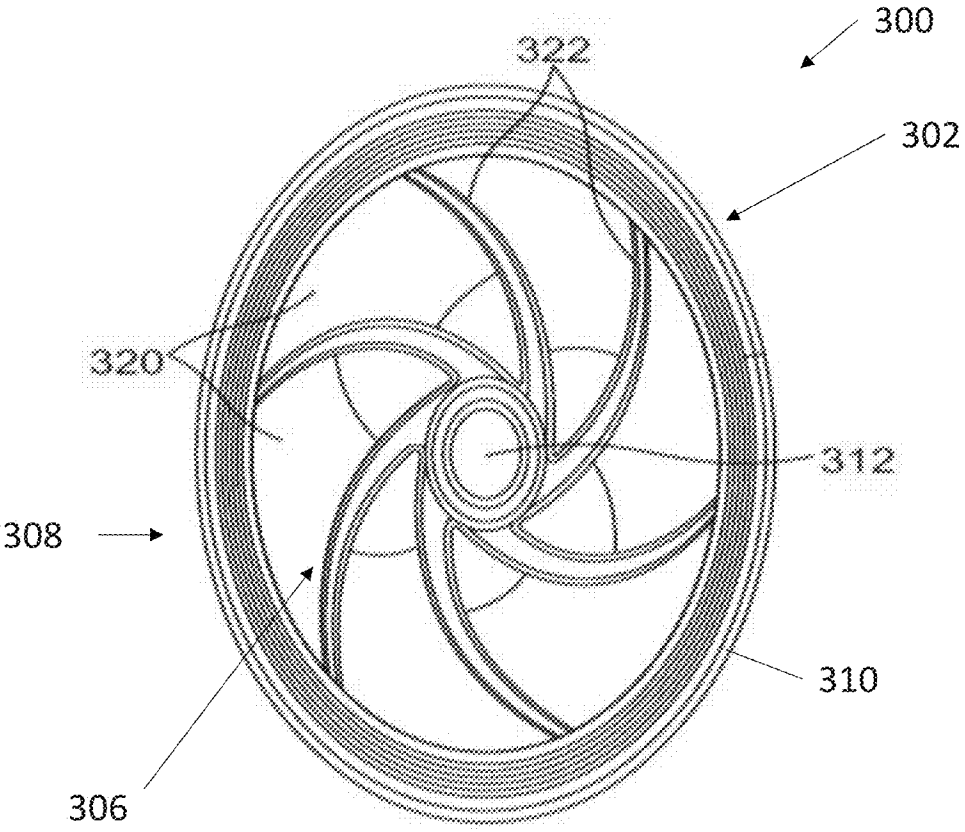
FIG. 2B shows a top view of the exemplary bowl according to at least one embodiment of the present invention.

As shown for example in FIG. 2B, in some embodiments, the bowl comprises at least six such compartments. However, one of ordinary skill in the art will appreciate that a higher or lower number of compartments may be formed without departing from the scope of the invention. In this way, a variety of organic matter, such as tobacco/shisha having different flavors, may be mixed or otherwise combined in a single bowl for smoking As shown for example in FIG. 2B, in some embodiments, the internal walls may be spirally oriented. The spiral orientation may facilitate mixing of flavors. Although not specifically shown, in some embodiments, the compartments may be non-identical. For example, some compartments may be larger than others. As an alternative example, the compartments may be concentrically oriented, or partially thereso. In at least some embodiments, the internal walls facilitate even heating.

In some embodiments the compartments are slightly recessed from the elevation of the rim, forming a space between the cover and the organic matter to be smoked so as to promote airflow from the organic matter to the hollow tube.

FIG. 2B shows a top view of the bowl. The compartments are shown in the spiral configuration about the central hollow tube. The compartments may provide flavor mixing advantages not present in the art. For instance, one compartment can be used for a first flavor of tobacco while a second compartment can be used for a second flavor, and so on until each compartment is filled. Unique and easily reproducible combinations can be created by a user based on this design. Additionally, the compartments may be used to measure the amounts of respective different flavorings so as to generate an easily reproducible ratio.

Figure 2C:
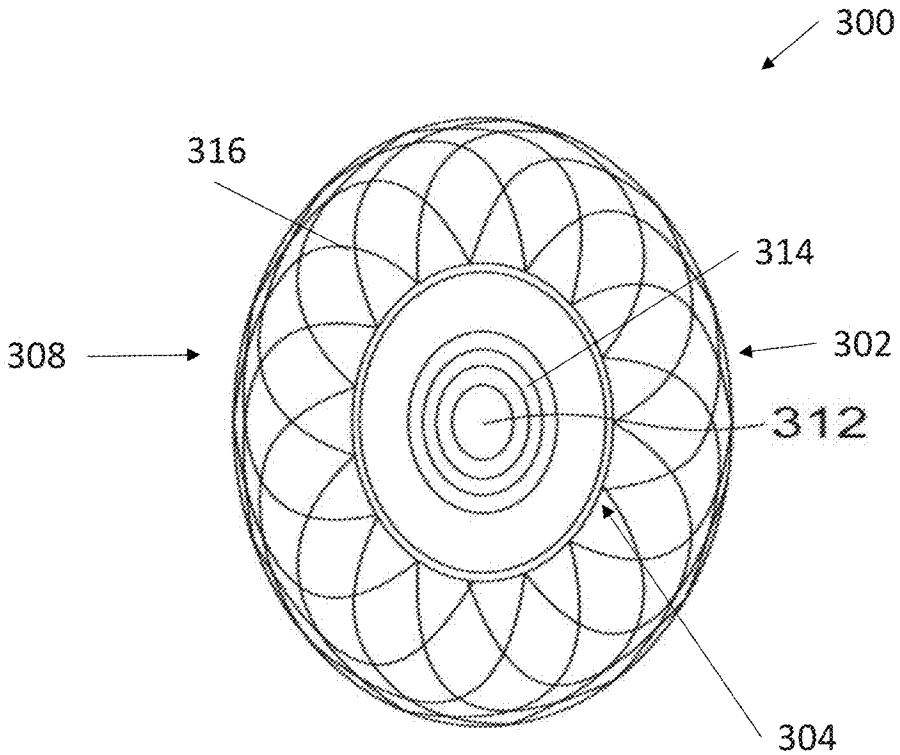
FIG. 2C shows a bottom view of the exemplary bowl according to at least one embodiment of the present invention.
Figure 2D:
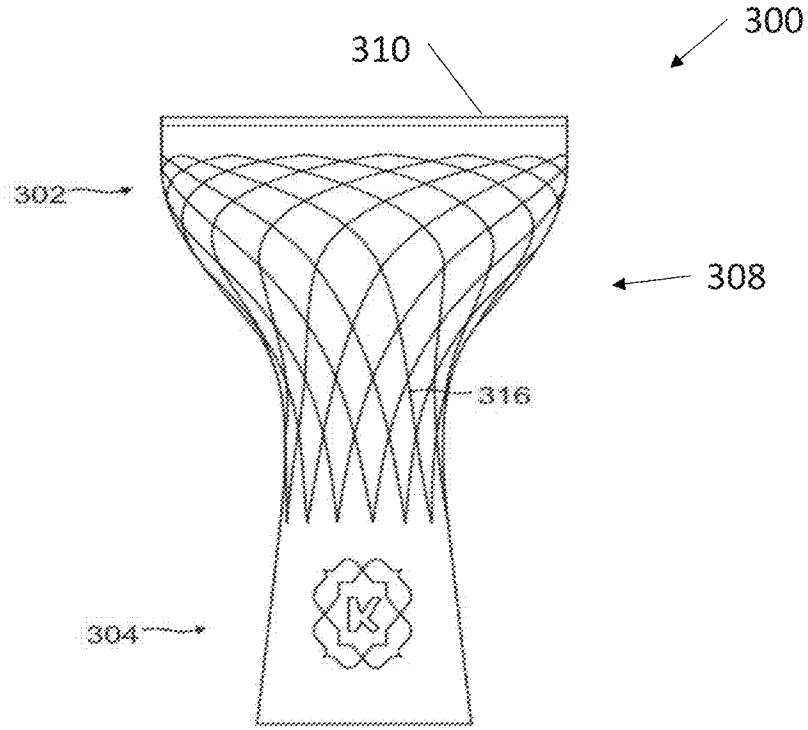
FIG. 2D shows a side view of the exemplary bowl according to at least one embodiment of the present invention.
Figure 2E:
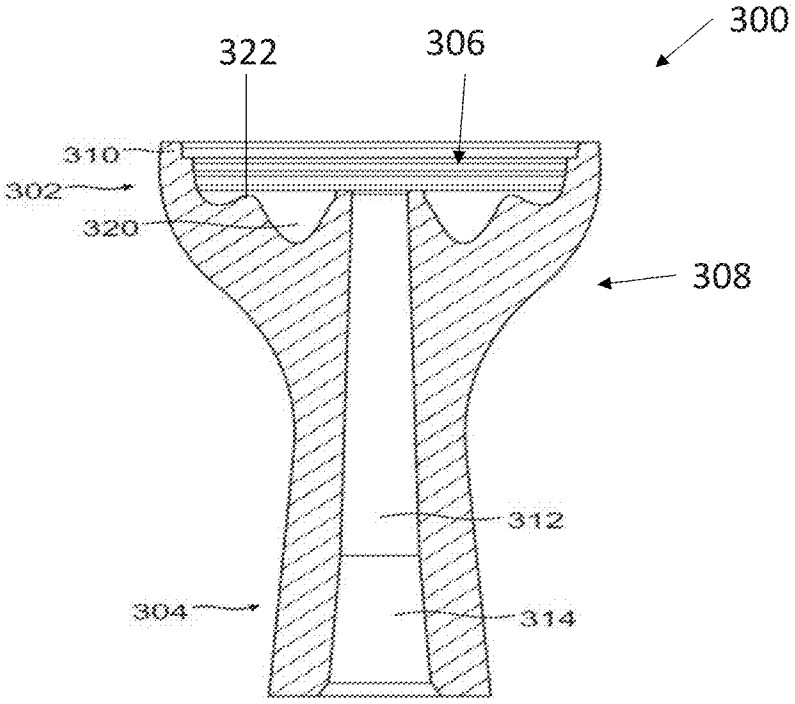
FIG. 2E shows a cutaway view of the exemplary bowl according to at least one embodiment of the present invention.

As shown for example in FIG. 2C and FIG. 2E, the bowl stalk may further comprise the grommet 314 for effecting the substantially airtight seal with the water pipe stem.

As shown for example in FIG. 2D, the exterior surface of the bowl may comprise a grip portion 316. In some embodiments, this grip portion may include a friction surface providing additional grip to the user.

In at least one embodiment, bowl 300 is made of silicone material. Silicone can have advantages such as improved insulation around the head and improved heat distribution inside the head. In other embodiments clay, marble, glass, various metals, or other appropriate flexible and inflexible materials can be used. In still other embodiments, combinations of the aforementioned materials can be used.

As shown for example in FIG. 2E, the rim portion 310 may further comprise tread or ribs for frictionally coupling a ventilated cover, such as the exemplary ventilated cover show for example in FIG. 3, as well as the ventilated cover described in U.S. patent application Ser. No. 13/489,475, filed on Jun. 6, 2012.

FIG. 3 illustrates an exemplary ventilated cover 500 for use in accordance with at least one embodiment of the present invention. The ventilated cover includes a platform 520 on which to support coal or other heating source, and a cap 540 resting on the platform so as to form a heating chamber, the airflow to which is controllable by rotation of the cap relative to the platform.

Figure 3A:
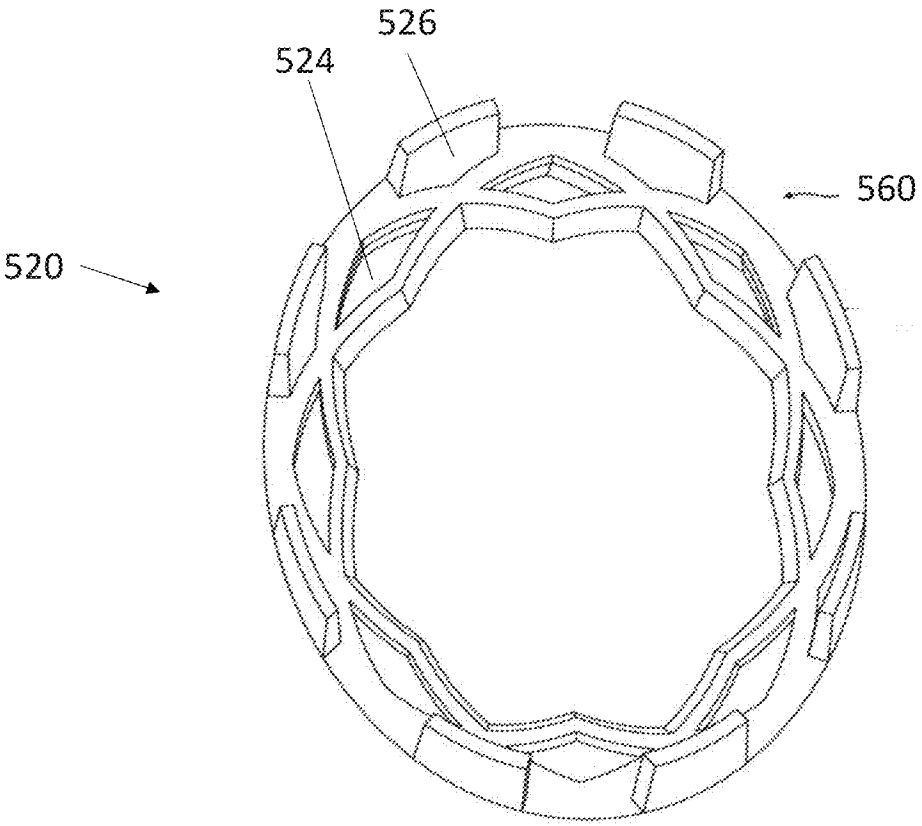
FIG. 3A shows a perspective view of an exemplary ventilated cover according to at least one embodiment of the present invention.
Figure 3B:
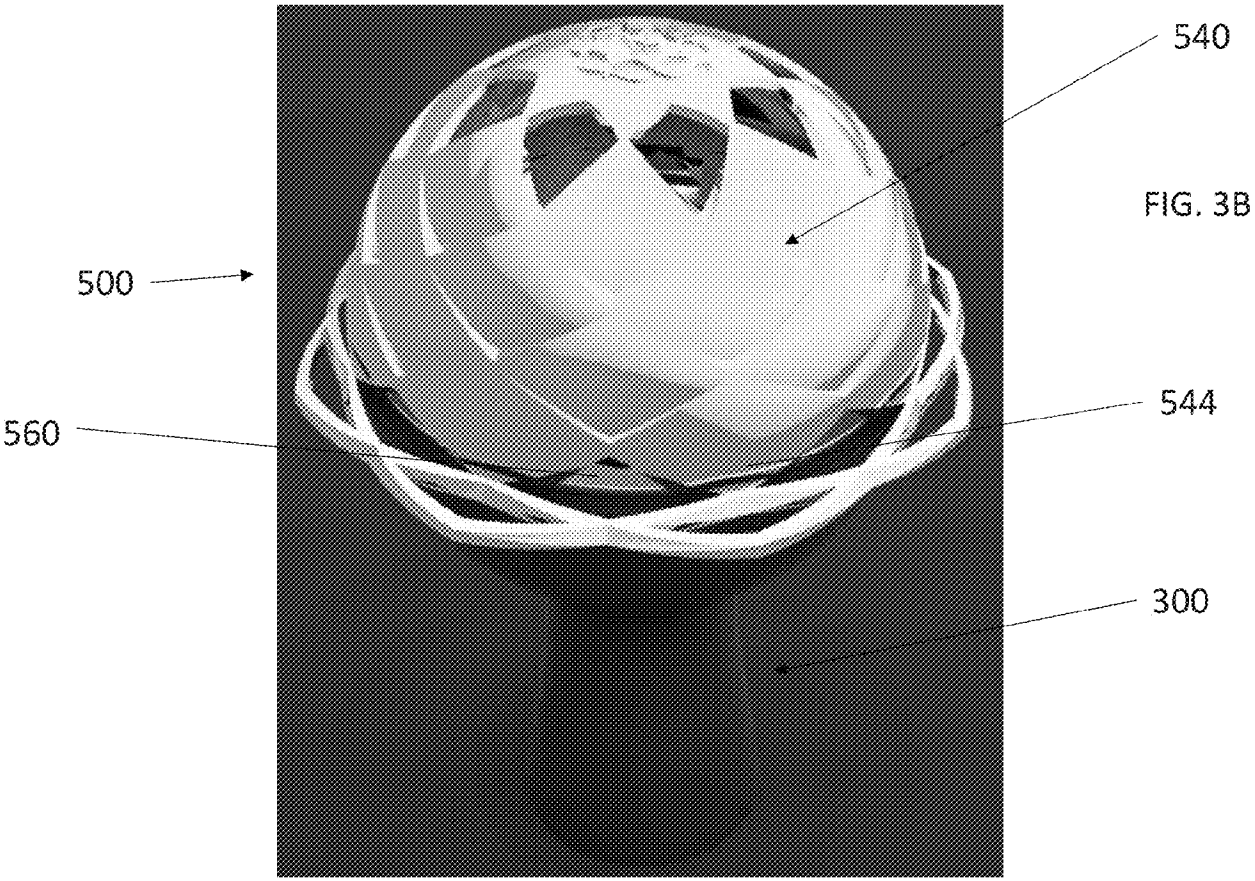
FIG. 3B shows a perspective view of the exemplary ventilated cover according to at least one embodiment of the present invention.

As shown in FIG. 3A-3B, the platform preferably comprises a recessed tray for containing the heating source. The platform also preferably comprises a plurality of perimeter bowl vents 524 for permitting airflow between the heating chamber and the bowl while in operation. The platform also comprises as a plurality of perimeter vertical protrusions 526 that mate with corresponding protrusions 544 of the cap to form adjustable side vents 560 for controlling the airflow between the exterior atmosphere and the heating chamber. As the cap is rotated relative to the platform, the respective protrusions and spaces therebetween (i.e. the formed side vents) transition between fully open, partially open and fully closed. In this manner, airflow to the heating chamber may be controlled. In some embodiments, the cap may further comprise additional vents, which may or may not be adjustable.

In some embodiments, the protrusions comprise flared interior surfaces for directing airflow toward the heating source and/or towards the bowl vents.

The enablements described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. A bowl for a water pipe comprising: a hemispherical bowl head, comprising:
- an upper rim;
- an interior space defined by an inner surface of the bowl;
- a centrally located hollow tube;
- one or more walls extending from the inner surface to the hollow tube; and
- a plurality of compartments separating the inner space, each defined by the inner surface of the bowl and at least one wall and located adjacent to the centrally located hollow tube, for holding organic matter to be smoked by a user,
- wherein an upper surface of the at least one wall is recessed beneath an upper elevation of the upper rim, forming a space between the at least one wall and the upper elevation of the upper rim.

2. The bowl for a water pipe of claim 1, further comprising:
- a stalk extending downward from the hemispherical bowl head and located opposite the upper rim,
- wherein the hollow tube extends from the hemispherical bowl head through the stalk.

3. The bowl for a water pipe of claim 2, wherein the stalk further comprises:
- an internal grommet located at an end of the stalk opposite the hemispherical bowl head, wherein the grommet is operable to seal the hollow tube with a stem of a water pipe.

4. The bowl for a water pipe of claim 3, wherein the seal is airtight.

5. The bowl for a water pipe of claim 1, wherein the bowl is silicone.

6. The bowl for a water pipe of claim 1, further comprising:
- a gripping feature on an external surface of the bowl.

7. The bowl for a water pipe of claim 1, further comprising:
- a coupling mechanism for coupling the upper rim with a ventilated cover.

8. The bowl for a water pipe of claim 7, wherein the ventilated cover includes a heating source platform to support charcoal or another heating source and wherein the coupling mechanism comprises a thread.

9. The bowl for a water pipe of claim 7, wherein the ventilated cover includes a heating source platform to support charcoal or another heating source and wherein the coupling mechanism comprises at least one rib.

10. The bowl for a water pipe of claim 1, wherein the plurality of compartments are arranged in a spiral formation emanating from the hollow tube.

11. A system for facilitating smoking of tobacco from a hookah, comprising:
- a hemispherical bowl head, comprising:
  - an upper rim;
  - an interior space defined by an inner surface of the bowl;
  - a centrally located hollow tube;
  - one or more walls extending from the inner surface to the hollow tube; and
  - a plurality of compartments separating the inner space, each defined by the inner surface of the bowl and at least one wall and located adjacent to the centrally located hollow tube, for holding organic matter to be smoked by a user,
- wherein an upper surface of the at least one wall is recessed beneath an upper elevation of the upper rim, forming a space between the at least one wall and the upper elevation of the upper rim.

12. The system for facilitating smoking of tobacco from a hookah of claim 11, further comprising:
- a ventilated cap for containing a heating source.

13. The system for facilitating smoking of tobacco from a hookah of claim 12, wherein the ventilated cap further comprises:
- a heating platform for supporting a heating source above the bowl.

14. The system for facilitating smoking of tobacco from a hookah of claim 13, wherein the heating platform further comprises:
- a central surface including a depression;
- at least one perimeter vent of the platform to allow air to pass between an area above the central surface and below the central surf ace;
- at least one perimeter wall located around an exterior of the heating platform for containing the heating source; and
- at least one exterior vent located in the at least one perimeter wall.

15. The system for facilitating smoking of tobacco from a hookah of claim 12, wherein the ventilated cap further comprises:
- a cover forming a chamber; and
- at least one side vent.

16. The system for facilitating smoking of tobacco from a hookah of claim 15, wherein the cover further comprises:
- at least one protrusion for resting on the heating platform.

17. The system for facilitating smoking of tobacco from a hookah of claim 15, wherein the cover is rotatable.

18. The system for facilitating smoking of tobacco from a hookah of claim 15, wherein the cover is removable.

* * * * *